US011305979B2

(12) United States Patent
Kadakia et al.

(10) Patent No.: US 11,305,979 B2
(45) Date of Patent: Apr. 19, 2022

(54) AUTOMATIC FUELING SYSTEM AND METHOD FOR HYDRAULIC FRACTURING EQUIPMENT

(71) Applicant: Permian Global, Inc., Odessa, TX (US)

(72) Inventors: Alpesh Kadakia, Palo Alto, CA (US); Ryan Burries, Midland, TX (US); Brent Bruner, Decatur, TX (US); Fernando Garcia, San Francisco, CA (US); Danny Jones, San Angelo, TX (US)

(73) Assignee: Permian Global, Inc., Odessa, TX (US)

( * ) Notice: Subject to any disclaimer, the term of this patent is extended or adjusted under 35 U.S.C. 154(b) by 280 days.

(21) Appl. No.: 16/576,939

(22) Filed: Sep. 20, 2019

(65) Prior Publication Data

US 2021/0087048 A1 Mar. 25, 2021

(51) Int. Cl.
*B67D 7/22* (2010.01)
*B67D 7/78* (2010.01)

(52) U.S. Cl.
CPC *B67D 7/22* (2013.01); *B67D 7/78* (2013.01)

(58) Field of Classification Search
CPC ..... B67D 7/22; B67D 7/78
See application file for complete search history.

(56) References Cited

U.S. PATENT DOCUMENTS

| | | | | |
|---|---|---|---|---|
| 6,616,036 | B2 * | 9/2003 | Streicher | B67D 7/346 235/381 |
| 6,931,305 | B2 | 8/2005 | Sherwood | |
| 7,594,414 | B2 * | 9/2009 | Wilding | F25J 1/0262 62/611 |
| 9,346,662 | B2 * | 5/2016 | Van Vliet | B67D 7/04 |
| 9,371,830 | B2 | 6/2016 | Moffitt | |
| 9,440,843 | B2 * | 9/2016 | Polzin | B67D 7/04 |
| 9,586,805 | B1 | 3/2017 | Shock | |
| 9,725,295 | B2 | 8/2017 | McKay et al. | |
| 9,815,683 | B1 * | 11/2017 | Kalala | B67D 7/3218 |
| 9,857,804 | B2 * | 1/2018 | Isom | F17C 11/002 |
| 10,633,243 | B2 * | 4/2020 | Shock | B65H 75/4402 |
| 10,759,649 | B2 * | 9/2020 | Haile | B67D 7/04 |

(Continued)

*Primary Examiner* — Timothy L Maust
(74) *Attorney, Agent, or Firm* — Henry J. Cittone; Cittone Demers & Arneri LLP

(57) ABSTRACT

The present invention provides a smart and automated system that is used for refueling of frac truck tanks during fracturing operations. The system is used to refuel the frac truck tanks which are constantly working in the high pressure and high-temperature zone for the fracturing of the wellbore to extract oil and gas. For safety, the system is equipped with explosion/fire free wiring system. The system incorporates inventive fuel valve to avoid the fuel clogging that increases the frac truck performance. The system employs artificial intelligence (AI) and cloud-based software for ease of operation and to maximize economic performance. The system is equipped with artificial intelligence and Programmable Logic Controller (PLC) software and incorporates charge pump and loop systems which maintain a predetermined pressure (in Pounds per Square Inch (PSI) unit) in each loop so as to maximize the performance and control function in the refueling system.

11 Claims, 10 Drawing Sheets

(56) References Cited

U.S. PATENT DOCUMENTS

| | | | | |
|---|---|---|---|---|
| 10,794,228 | B2 * | 10/2020 | Huntington | F01K 13/006 |
| 10,882,732 | B2 * | 1/2021 | Haile | B67D 7/0401 |
| 10,961,835 | B2 * | 3/2021 | Mazrooee | E21B 43/267 |
| 2007/0181212 | A1 | 8/2007 | Fell | |
| 2008/0051939 | A1 * | 2/2008 | Dobbins | G06Q 50/30 700/275 |
| 2012/0284075 | A1 | 11/2012 | Blagg et al. | |
| 2018/0057348 | A1 | 3/2018 | Lowrie | |
| 2018/0229998 | A1 * | 8/2018 | Shock | B60P 3/035 |

* cited by examiner

AUTOMATIC FUELING SYSTEM AND METHOD FOR HYDRAULIC FRACTURING EQUIPMENT

FIELD OF THE INVENTION

The present invention relates to fueling system for hydraulic fracturing equipment, and more specifically to a system and method for automatically fueling fracturing equipment and reporting feeds of fuel filling operation to operator's systems in real time using artificial intelligence.

BACKGROUND

A number of industrial processes require the use of multiple equipment/machinery to be operated continuously at a work site, for example, at a hydraulic fracturing or fracking site. In such locations, multiple pump trucks are needed to provide the fracking site with sufficient fracking fluid. Such trucks disadvantageously need to be operated continuously during such fracking operations and therefore will also be required to be refueled during operation.

Mobile refueling systems are an efficient and effective solution for hot fueling of equipment/machinery at any work site. Some of these systems are also equipped with transport facility that is useful for fueling fracturing sites, commercial fleets, bulk tanks, and construction companies with commercial generators. The need for a mobile refueling system is in huge demand as these systems provide efficient and time-saving technique along with great safety for the workers during filling of fuel into multiple tanks around the work site.

In the case of hydraulic fracturing, the work site has various types of large machinery for performing continuous work of fracturing operation over an extended period of time. At these sites, the main work is to make a wellbore very deep into the ground so as to reach the hydrocarbon reservoirs like oils, and gases. The machinery for fracturing operation is powered by a combustible engine with fuel supplied from a fuel tank that has a limited fuel capacity. It may be necessary to refuel the machinery's fuel tank even during the machinery's continued operation in order to prevent the fuel tank from running empty and shut-down of the machinery as shut-downs result in large cost and reduce efficiency. More preferably, to avoid shut-downs, fuel is replenished in a hot-refueling operation while the equipment continues to run. The equipment and machinery works in very high temperature and pressure, therefore, the chances of explosion and fire are very high.

The prior refueling solutions were incapable to monitor real-time information on fuel level of the receiving tanks as these systems were based on manual checkup of fuel level inside the fuel tank that was possible only if the operator stays near to each fuel tank. Further, the conventional systems fail to provide accurate data about the remaining fuel in the main fuel source; unable to track the amount of fuel transfer from each reel to frac truck tanks; and inefficient to provide real-time billing of fuel transfer for each fuel tank of frac truck either separately or collectively. There is also a need to ensure the protection of the workers from the hot danger zone and explosions during refueling of frac truck tanks. In the past, various refueling systems and associated methods are used for supplying fuel to hydraulic fracturing sites, commercial fleets, bulk tanks, and commercial generators used by construction companies. However, these available systems are complex in nature; involve unnecessary costs of hardware and implementation.

In order to overcome the aforementioned problems, the present invention provides a centralized mobile fuel filling system to refuel multiple frac tanks simultaneously. The system comprises of an explosion/fire free wiring to avoid any misfiring during the operation. The fuel filling system comprises a fuel valve on the saddle tank or receiving tank that is specifically designed to avoid fuel clogging and enhance frac truck performance. The fuel filing system utilizes a cloud-based software for the real-time monitoring of fuel distribution and operational activity. The system is equipped with artificial intelligence and Programmable Logic Controller (PLC) software that helps oil and gas companies to maximize economic performance and control the functioning from a remote location. Moreover, the system incorporates two charge pumps and two loop systems in order to maintain a predetermined pressure (in Pounds per Square Inch (PSI) unit) in each loop so as to maximize the performance and control function in the refueling system.

SUMMARY

The present invention provides a smart and automated system for refueling of frac truck tanks during fracturing operations. The system is used to refuel the frac truck tanks which are constantly working in the high pressure and high-temperature zone for the fracturing of the wellbore to extract oil and gas. In order to provide the safety of a worker, the system is equipped with explosion/fire free wiring system. The fuel filing system utilizes an inventive fuel valve to avoid the fuel clogging which increases the frac truck performance. The system of the present invention also employs artificial intelligence (AI) and cloud-based software that results in ease of operation and helps the oil and gas companies to maximize economic performance. The present invention includes computer-based software that predicts data related to fuel transfer and analyzes the fuel level in the tanks, their billing amounts, and flow rate modulation. Also, the present system provides greater safety and efficient way for the refueling of frac truck tanks and the overall system can be monitored and controlled remotely through wired/wireless means.

In an embodiment of the present invention fuel filling system for simultaneously filling a plurality of receiver tanks, the system comprising: a fuel storage tank draining fuel into two or more channels; a plurality of pumps installed at the end of each of the two or more channels feeding; fuel to a plurality of reels having a flow meter and an isolation valve to shut off fuel flow; a control chamber to manage and monitor fuel distribution.

BRIEF DESCRIPTION OF DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings.

DETAILED DESCRIPTION

Figure 1:
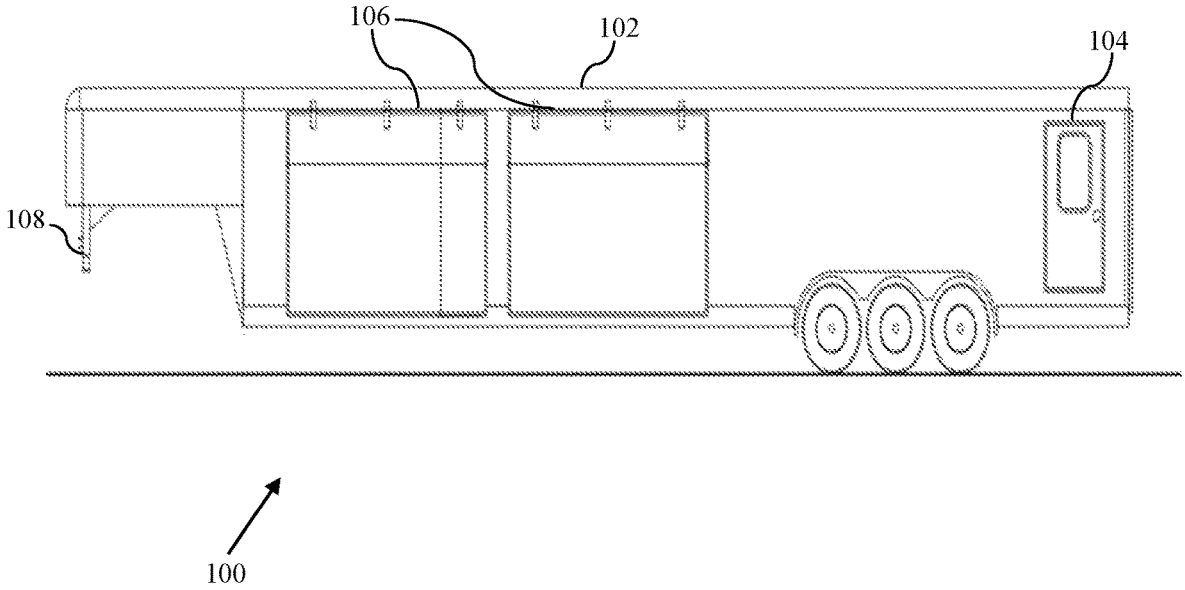
FIG. 1 illustrates a mobile trailer for an automated fueling system in accordance with an embodiment of the present invention.

In the following detailed description of embodiments of the invention, numerous specific details are set forth in order to provide a thorough understanding of the embodiment of invention. However, it will be obvious to a person skilled in art that the embodiments of invention may be practiced with or without these specific details. In other instances well known methods, procedures and components have not been described in detail, so as not to unnecessarily obscure aspects of the embodiments of the invention.

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present invention provides a smart and automated system that is used for refueling of frac truck tanks during fracturing operations. The system is used to refuel the frac truck tanks which are constantly working in the high pressure and high-temperature zone for the fracturing of the wellbore to extract oil and gas. In order to provide the safety of a worker, the system is equipped with explosion/fire free wiring system. The system incorporates inventive fuel valve to avoid the fuel clogging which increases the frac truck performance. The system of the present invention also employs artificial intelligence (AI), programmable logic controller (PLC) and cloud-based software that results in ease of operation and helps oil and gas companies to maximize economic performance. The system utilizes Internet of Things (IoT) sensors, in-line flow meters, fluid dynamics, and proprietary algorithms in order to maintain and control the fuel flow in precise manner. The PLC system is able to dynamically and independently modulate the fuel flow rate across various nodes in the system. Moreover, on leveraging structured and unstructured data sets and machine learning frameworks, the PLC can further identify non-standard fuel conditions and activate valves and other mechanical components to achieve optimized fuel delivery rates into each node. The controlling mechanism of the present invention includes proportional—integral—derivative controller (PID controller) that maintains the output such that there is zero error between process variable and desired output by closed loop operations. Artificial Intelligent (AI) is obtained by the integral term that seeks to eliminate the residual error by adding a control effect to historic data. Moreover, the system incorporates two charge pumps and two loop systems in order to maintain a predetermined pressure (in Pounds per Square Inch (PSI) unit) in each loop so as to maximize the performance and control function in the refueling system.

Additionally, the present invention comprises an Artificial Intelligence that determines data related to fuel transfer and analyzes the fuel level in the tanks, their billing amounts, and flow rate modulation. Also, the present system provides greater safety and efficient way for the refueling of frac truck tanks and the overall system can be monitored and controlled remotely through wired/wireless means.

FIG. 1 illustrates a mobile carrier vehicle or mobile trailer for an automated fueling system 100 in accordance with an embodiment of the present invention. Referring to FIG. 1, the automated fueling system 100 described herein is utilized to automatically monitor and assign fueling operations for hydraulic fracturing equipment, the aviation industry and alike. The automated fueling system 100 offers dramatic improvements over conventional technology, including the use of artificial intelligence to increase the efficiency of monitoring and assigning fueling operations and, thereby, reducing the costs associated with controlling fueling operations in hydraulic fracturing equipment, aviation industry etc.

The automated fueling system 100 is designed to be transported as a mobile trailer 102. Generally, the mobile trailer 102 is elongated and has first and second opposed trailer side walls that join first and second opposed trailer end walls. Most typically, the trailer 102 will also have a closed top. The trailer side walls define trailer width. The mobile trailer 102 may have wheels that permit the mobile trailer 102 to be moved by a vehicle from one site to other so as to service different hot-refueling operations.

The mobile trailer 102 is lightweight, built using aluminium metal and customizable to suit individual's requirement. The mobile trailer 102 has doors 104 on the front and rear, and a plurality of reels on both side for release and expansion of hoses outside the trailer 102. The trailer 102 contains all the major parts such as reels, hoses, diesel generator, fuel storage tank 106, pumps, in-line flow meters, pressure guage, Programmable Logic Controller (PLC) programming, Proportional-Integral-Derivative (PID) controller, software and control enclosed chamber at the rear of the trailer. Since the trailer is a non-motorized vehicle, it needs to be pulled by a semi-truck to be transported to different locations, including customer site and shop. Therefore, an elongated hook 108 is provided at the front of the trailer that helps in pulling the trailer by a semi-truck and transporting it to different locations.

The fuel storage tank 106 of the trailer 102 is equipped with double/bund wall design to secure the fuel safely. The audible and/or visual alarm system are installed on the fuel storage tank 106 for overfill protection. The fuel storage tank 106 equipped with: one or more air vent with weather cap, a calibrated fluid level dipstick to check the fuel level in the tank 106, an anti-syphon valve to normalize the pressure inside the pipes when you turn off the fuel to prevent it from flowing backward, ladder arrangement at either sides of tank, tank floor has slope towards front for water collection, bunded (spill contained) pump bay housing with removable ventilation panels, front security doors, statutory signage and inside tank visibility. The fuel storage tank 106 is designed to hold more than 20,000-gallon fuel capacity.

The present invention utilizes a blockchain-based distributed ledger for real-time monitoring of fuel metering and billing. It provides dynamic rate flow modulation, data collection, reel level IOT sensors and analysis module to optimize rate of production. It utilizes an asset level monitoring and recommendation engine to deliver high levels of fuel efficiency across the fleet. The asset level recommendation engine utilizes a antimicrobial agent which serves as a very effective shock-dose treatment for contaminated diesel fuel (or petrol or kerosene) and water bottoms in fuel storage tanks. Because contamination will occur in both the water and fuel phases, it is necessary to demonstrate efficacy in both diesel and water. Water and fuel samples are tested to determine microbial loads before and after treatment with antimicrobial agent.

The fuel filling system comprises a controlling unit to control the operations during fuel filling. The fuel filing system utilizes a proprietary platform that leverages the latest innovation in edge computing, wireless communications, predictive data analytics, and artificial intelligence to enable oil and gas producers to autonomously and intelligently optimize production and the well-site. The system provides cloud-based frac management software to automate and optimize the management of small to large frac/wells. The system introduces an advanced machine learning software to help oil and gas companies optimize development programs to maximize economic performance. The system provides a platform that standardizes the delivery of time-series and field-created frac data directly to an operator's system in real time.

In the preferred embodiment of the present invention the trailer 102 may include two compartments: first compartment includes the physical components for distributing fuel, such as diesel fuel, fuel source such as fuel tank and a second compartment serves as an isolated control chamber for managing and monitoring fuel distribution. The control chamber includes software, hardware, or both that is configured to carry out any of the functions described herein. In one further example, the control chamber includes a programmable logic controller (PLC) with a touch-screen to receive input from user and display the status of real time data. For example, the screen may simultaneously show multiple fluid levels of the equipment that is being serviced or refueled by the trailer.

Figure 2:
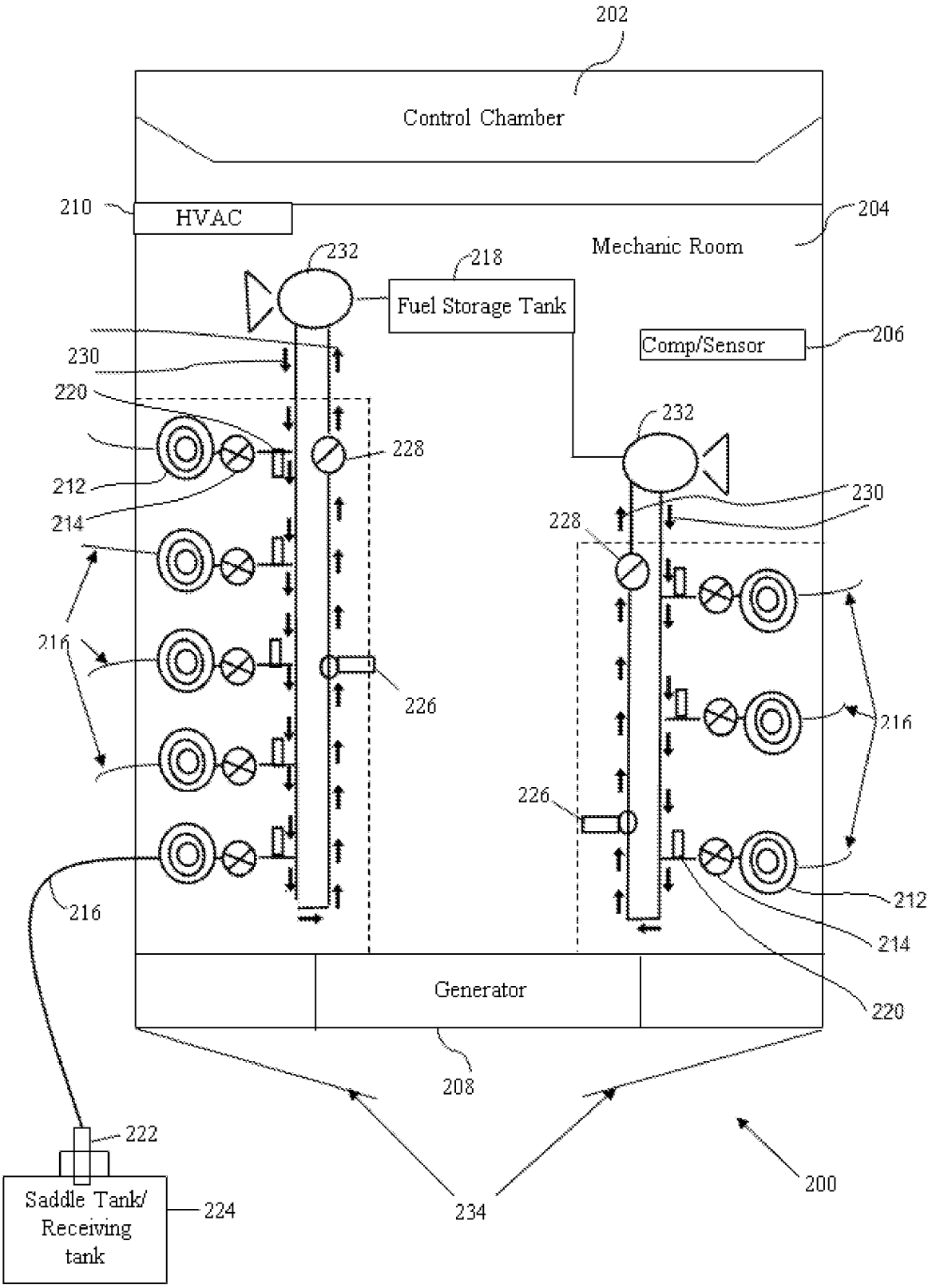
FIG. 2 illustrates a layout of the Artificial Intelligence (AI) enabled fueling system in accordance with an embodiment of the present invention.

FIG. 2 illustrates a layout of the automated fueling system 200 in accordance with an embodiment of the present invention. Referring to automated fueling system 200, the mobile trailer 102 has two compartments. A first compartment 204 includes the physical components for distributing fuel, such as diesel fuel, fuel source such as fuel storage tank (fuel delivering tank) and a second compartment 202 serves as an isolated control chamber for managing and monitoring fuel distribution. Both the compartments 202 and 204 are separated by an inside wall. The second compartment 202 may be insulated with a fire resistant or retardant material. In the event of a fire threat, a worker may take cover in the second compartment 202. The fire resistant or retardant material may shield the second compartment and thus temporarily protect the worker under such circumstances. The second compartment or control chamber 202 may include an auxiliary escape door to provide exit from the trailer 102. Thus, if needed, a worker may exit the trailer 102 other than the main exit of first compartment 204. The control chamber 202 includes software, hardware, or both that is configured to carry out any of the functions described herein. In one further example, the control chamber 202 includes a programmable logic controller (PLC) that provides automation of various electro-mechanical processes in the trailer 102. PLC consists of a microprocessor which is programmed using the computer language. The hardware components of a PLC system may include CPU, Memory, Input/output, Power supply unit and programming device. The control chamber of the present invention includes proportional-integral-derivative controller (PID controller) that maintains the output such that there is zero error between process variable and desired output by closed loop operations. Artificial Intelligent (AI) is obtained by the integral term that seeks to eliminate the residual error by adding a control effect to historic data.

The first compartment 204 comprises a fuel storage tank 106 containing a quantity of fuel and a fuel output/outlet mechanism. The fuel output/outlet mechanism is comprised of plurality of fuel pipes or hoses 216, plurality of reels 212, an actuated valve 214 is associated with each plurality of reels 212, plurality of in-line flow meter 220, couple of charge pumps 232 equipped on both side of the trailer operable to draw the fuel out of the storage tank 218, couple of pressure control valves 228 coupled with each charge pumps 232 to maintain the pressure at predetermined level, in-line flow meters 220 individually connected to each outlet of the fuel flow to measure the amount of fuel flow through each hose 216, one end of the hose is connected to fuel outlet and other end to respective vehicle/equipment for delivering fuel. As shown in the FIG. 1, the trailer 102 has a door 104 on the front and on the rear (the rear door is not shown in FIG. 1), and plurality of reels 212 equipped on both sides of the trailer. The reels 212 equipped on both sides of the trailer may be any number as per convenience and requirement. The hoses 216 are stored in the reel 212 that makes to exit and expand the hoses outside the trailer 102. Each reel 212 is associated with an actuated fuel valve 214 to control fuel flow. Each hose 216 is wound, at least initially, on a reel 212 that is rotatable to extend or retract the hose 216 externally through one or more windows of the trailer 102. The plurality of hoses 216 stored in the plurality of respective reels 212 may be pulled out to equipment through an opening in the trailer 102 wall. Each hose 216 may include a connector end 222 and each integrated fuel cap sensor may have a corresponding mating connector to facilitate rapid connection and disconnection of the hose 216 with the integrated fuel cap sensor. For example, the connector end 222 and mating connector on the integrated fuel cap sensor form a hydraulic quick-connect.

The reels 212 may be mounted either internally or externally on the trailer 102, and may include electric or manual hose rewinders. The fuel source may be formed in part by one or more fuel tanks that are used to store fuel. The tanks may be mounted on the same trailer as the rest of the automated fueling system 100 or on a separate trailer.

In the preferred embodiment of the present invention the reels 212 are electric motor driven and have the ability to rewind/retract in and out. Each reel capacity may be but not limited to 475 ft for a ¾"' hydraulic hose 216. The retract mechanism of the reel comprises reliable chain & sprocket drive on motor driven models, solid steel direct hand crank with smooth round handle and metal bevel crank and gear construction. As far as the design and structure of the reel is concerned it has welded hybrid frame with added bolts, low profile outlet riser and open drum slot design for flat smooth hose wrap. Permanently lubricated self-aligning pillow block bearing for trouble-free smooth rotation & robust lubricated horizontal surface mount bearing for easy rotation have been provided. Further, the long-handled locking pin is provided to secure reel from rotation during transport or storage.

Each reel 212 has a reel diameter, which is the outside diameter or dimension of the reel 212. Most typically, all or substantially all of the reels 212 will be the same size and thus have a common reel diameter.

The embodiments described herein uses charge pump 232 to draw the fuel out of the storage tank. The charge pump 232 used to control and modulate the speed of fuel flow from the storage tank 218. The charge pump 232 facilitates an efficient way to control the speed of fuel flow without using any external speed drive, hence, improves energy efficiency of the present embodiment. It uses solid state components to produce a pulse-width modulated current that varies the power and frequency supplied to the motor. This enables accurate control of the motor speed over a broad range. Charge pumps are used in connection with PLC and PID controller to control and modulate the flow rate of the fuel according to demand, often with large savings in energy use.

In the preferred embodiment of the present invention a close loop system 230 is formed by charge pump 232, plurality of reels 212 coupled with actuated valve 214 individually and pressure control valve 228 on either side of the trailer. The pressure control valve 228 facilitates a predetermined pressure in the loop 230, the predetermined pressure may be, but is not limited, to 25 pounds per square inch (PSI). The pressure control valve 228 is controlled by the artificial intelligence (AI) incorporated in control chamber 202 of the trailer. The actuated valve 214 coupled to each reel individually in both loop systems 230 is operated by the control signal received from the programming logic controller (PLC) and proportional-integral-derivative (PID). The PLC and PID incorporated in control chamber 202 controls the actuated valve 214 of the loop system 230 as per the signal/feedback received from the level sensor of fuel receiving tank 224 of machine/equipment. The pressure maintained by the pressure control valve 228 in the loop system 230 is sufficient to push out the fuel from actuated valve as needed by any machine/equipment working in the field.

In another embodiment of the present invention a variable-speed drive (VCD) can be coupled with charge pump to control and modulate the speed of fuel flow from the storage tank 218. The variable-speed drive (VCD) coupled with charge pump may improve its energy efficiency by using variable speed control instead of throttling or other less efficient flow control methods.

A proportional-integral-derivative (PID) controller delivers the control at desired level. In low cost simple ON-OFF controller available at present time only two control states are possible, like fully ON or fully OFF of the valve. It is used for limited control application where these two control states are enough for control objective. However oscillating nature of this control limits its usage and hence it is being replaced by PID controllers. PID controller maintains the output such that there is zero error between process variable and set point or desired output by closed loop operations. Proportional or P-controller gives output which is proportional to current error. It compares desired output or set point with actual value or feedback process value. The resulting error is multiplied with proportional constant to get the output. If the error value is zero, then this controller output is zero. Due to limitation of p-controller where there always exists an offset between the process variable and set point, I-controller is needed, which provides necessary action to eliminate the steady state error. It integrates the error over a period of time until error value reaches to zero. It holds the value to final control device at which error becomes zero. I-controller doesn't have the capability to predict the future behavior of error. So it reacts normally once the set point is changed. D-controller overcomes this problem by anticipating future behavior of the error. Its output depends on rate of change of error with respect to time, multiplied by derivative constant. It gives the kick start for the output thereby increasing system response.

Hence, the PID controller used in the present invention operates the actuated valve precisely and smoothly when the multiple factors/inputs are present, it also facilitates to modulate the rate at which fuel flows instead a binary on or off condition, thus allowing for a more continuous fueling method. It also provides an enhancement in spill prevention feature from the ability to modulate flow rate.

The method to deliver the fuel to one or more frac truck tank 224 using artificial intelligence based fueling system 100 comprises: pulling one or more hose 216 from one or more reel 212 and connecting it to one or more frac truck tank or receiving tank 224; selecting automatically a reel coupled with actuated valve 214 to supply the fuel in saddle tank or receiving tank 224 based on feedback sent by fuel level sensor to the PLC and PID respectively; opening of the actuated fuel valve 214 for the selected reel through PLC/PID controller automatically; stopping/disabling actuated fuel valve 214 automatically, when fuel level of receiving tank reaches a predefined set point (using tank level sensor).

Additionally, in the embodiment of the present invention the first compartment 204 also includes a sensor 206, High Voltage AC power supply 210, generator 208 and a mechanic chamber. The mobile trailer comprises a trailer end wall that has an outside door opening 234. The sensor 206 holds integrated fuel cap sensors (when not in use), or at least portions thereof. The sensor 206 may be but not limited to fluid sensor, float sensor, level sensor, vibrating level switch or pressure transducer. When in use, each integrated fuel cap sensor is temporarily affixed to a piece of equipment (i.e., the fuel tank of the equipment) that is subject to the hot-refueling operation. Each hose 216 includes a connector end 222 and each integrated fuel cap sensor may have a corresponding mating connector to facilitate rapid connection and disconnection of the hose 216 with the integrated fuel cap sensor. For example, the connector end 222 and mating connector on the integrated fuel cap sensor form a hydraulic quick-connect. The sensor may be but not limited to fluid sensor, float sensor, level sensor, vibrating level switch or pressure transducer.

The sensor 206 preferably communicates with a control chamber 202 on the trailer 102 via a wireless communication channel, though a wired channel may also be used. For this purpose, the fuel level sensor preferably includes a wireless transceiver, such as an Accutec™ and the like. Transceiver may be provided with a mounting bracket (not shown) or clip for attachment to fuel storage tank 218. The control chamber 202 comprises a transceiver that is compatible with the transceiver at the sensor 206, such as an Accutec™ base radio, and a variety of control and display equipment according to the specific embodiment used. In an embodiment with plurality of automatically operated actuated valves 214, the control chamber 202 may comprise a conventional computer, input device (like keyboard, mouse) and display or displays. In a manual embodiment, the operator may be provided with a valve control console with individual toggles for remote operation of the plurality of valves 214, and the valve control console, or another console, may include visual representations or displays showing the fuel level in each of the tanks/cells. Any visual representation or display may be used that shows at least a high level condition (tank full) and a low level condition (tank empty or nearly empty) and preferably also shows actual fuel level. The console or computer display may also show the fuel level in the tanks or the rate of fuel consumption in the tanks.

As it is difficult to get power supply at the fracturing location to operate the different electrical/electronic equipment (like motor pumps, fully automated reel assembly, sensors etc.) of the trailer 102, a conventional generator 208 has been installed in the trailer 102 to supply power for electrical/electronic equipment on the trailer 102. Lights and suitable windows in the trailer 102 are provided so that the operator has full view of the equipment mounted on the trailer and the fracturing equipment being refueled. The spatial orientation of the control chamber 202, reels 212, tanks and other equipment such as the generators is a matter of design choice for the manufacturer and will depend on space requirements. The mobile trailer also includes a trailer end wall that has an outside door opening 234.

In the preferred embodiment of the present invention the CORE blockchain platform is a distributed database technology that allows secure transmission of information and real-time monitoring without control by any central authority. Sharing access to a growing chain of appended transactions eliminates costly reconciliations that occur between transportation providers and customers from freight rate management, track and trace the equipment, invoice calculation and payment remittance, in other words, the Freight Bill Audit and Pay (FBAP) process. Applying a blockchain solution to FBAP may save millions of dollars of the Oil & Gas (O&G) organizations, since the parties would access the same secured information on a distributed database, reducing the need for audits, third party audit and payment service providers, and lowering the risk of overpayments.

The process begins with the exploration and production (E&P) company that shares its drilling and production schedules with system 100 through a secure blockchain platform. Next, we send delivery schedule that automatically updates, as fuel supplier and logistics plans are put in place for materials to arrive on site at pre-agreed times. Using geolocation technology, fuel delivery trucks are tracked in real-time and the logistics plans are updated without any delay, enabling users to have real-time visibility into where fuel delivery trucks are at any given point in time.

Upon arrival at the site, the fuel is automatically inventoried and deployed to the E&P/fracking operator frac pump units through automated CORE fueling system. The present invention employs the geofence technology to invoice the client. Geofence technology is a location-based service in which an app or other software uses GPS, RFID, Wi-Fi or cellular data to trigger a pre-programmed action when a mobile device or RFID tag enters or exits a virtual boundary set up around a geographical location. This way system can invoice immediately following the Fuel delivery and deployment with the accurate freight rate, CORE equipment deployment and usage, and accessorial charges, enabling company/organization and other vendors to be paid immediately. The CORE system frac crew can perform the service with the operation recorded on the blockchain. Well production performance data is recorded and fed into the data lake for analysis and, similarly, fuel usage data is fed into planning systems to help improve forecasting in the future.

The automated fueling system 100 of the present invention also employs artificial intelligence (AI) and cloud-based software that provides ease of operation and helps the oil and gas companies to maximize economic performance. The present invention includes computer-based software that predicts data related to fuel transfer and analyzes the fuel level in the tanks, their billing amounts, and flow rate modulation. Also, the present system provides greater safety and efficient way for the refueling of frac truck tanks and the overall system can be monitored and controlled remotely through wired/wireless means.

The automated fueling system 100 may control and automatically assign fueling operations at one or multiple frac truck equipment through the use of computer-based artificial intelligence. The automated fueling system offers dramatic improvements over conventional technology, including the use of artificial intelligence to increase the efficiency of monitoring and assigning fueling operations and reducing the costs associated with controlling aircraft fueling operations. Thus, because of the computer-based artificial intelligence, the automated fueling system 100 has the capability to learn and better predict fueling times over a period of time.

The system 100 comprises an inventive fuel valve that is specifically designed to fit in the saddle tank of the frac truck/pump units. The valve is a mechanical float switch for shutting off fuel flow to prevent overfilling and spilling. The valve has a machined stainless steel and aluminum head specifically designed to avoid fuel clogging and enhance frac truck performance. It comprises an analog level sensor for wirelessly transmitting the fuel level to central controller of the control chamber 202.

Figure 3:
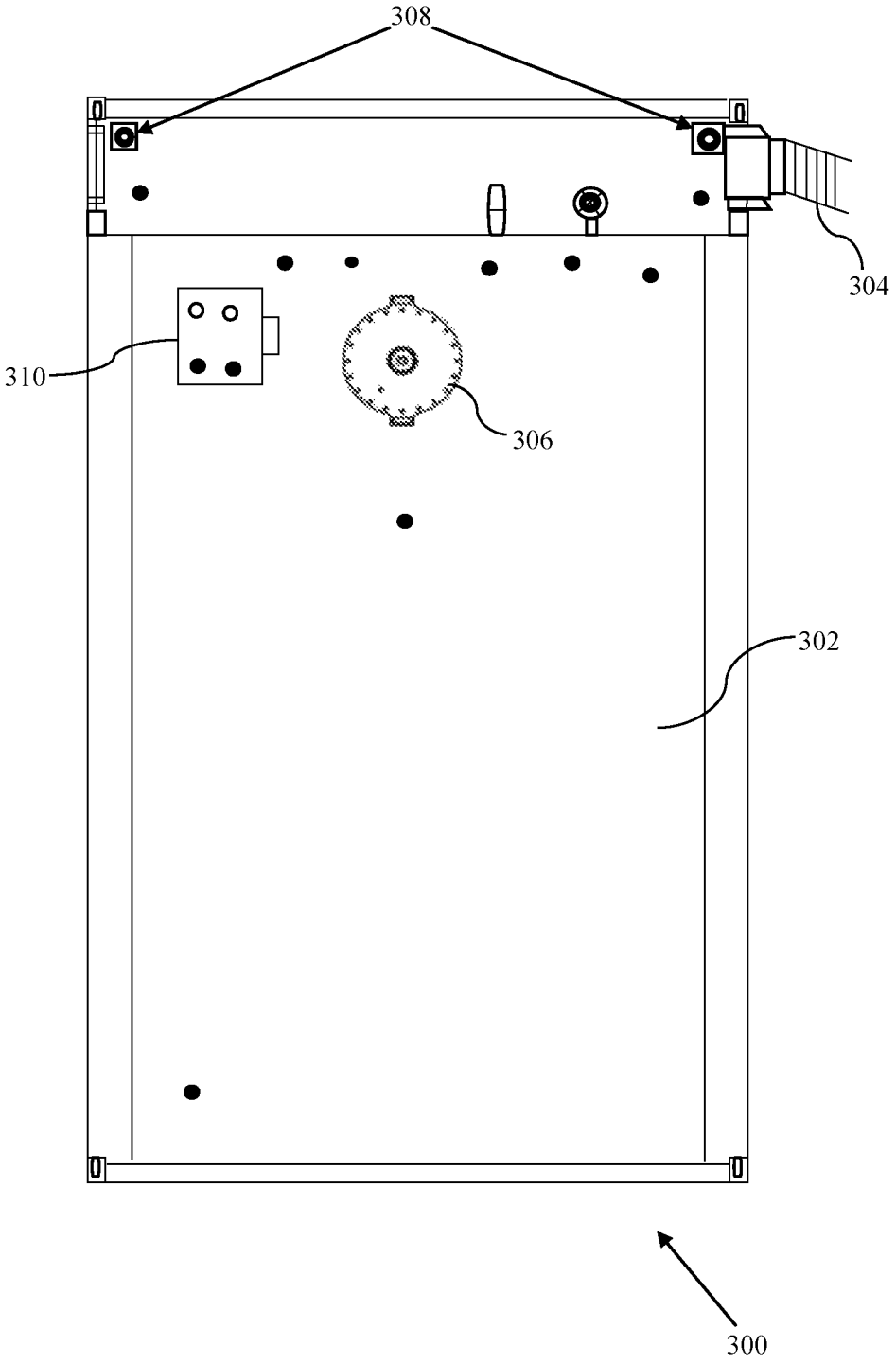
FIG. 3 illustrates a top view of the mobile trailer for the automatic fueling system in accordance with an embodiment of the present invention.

FIG. 3 illustrates a top view 300 of the mobile carrier vehicle or mobile trailer for the automatic fueling system 200 in accordance with an embodiment of the present invention. Referring to top view 300 of the mobile trailer, it shows the top 302 of the trailer 102; the fuel storage tank of the trailer may be accessed via hatches or man holes 306 for servicing and cleaning purposes. The fuel storage tank of the trailer is filled via filling valve connections 310 provided at the top of the trailer before the mobile trailer is transported to a work site or fracturing site, a set of hose mast assembly 308 is provided at both the rear ends to pass the air, it is reversible to both sides. A ladder arrangement 304 is provided to access the top 302 of the trailer 102 for fueling, servicing and other purposes.

Figure 4A:
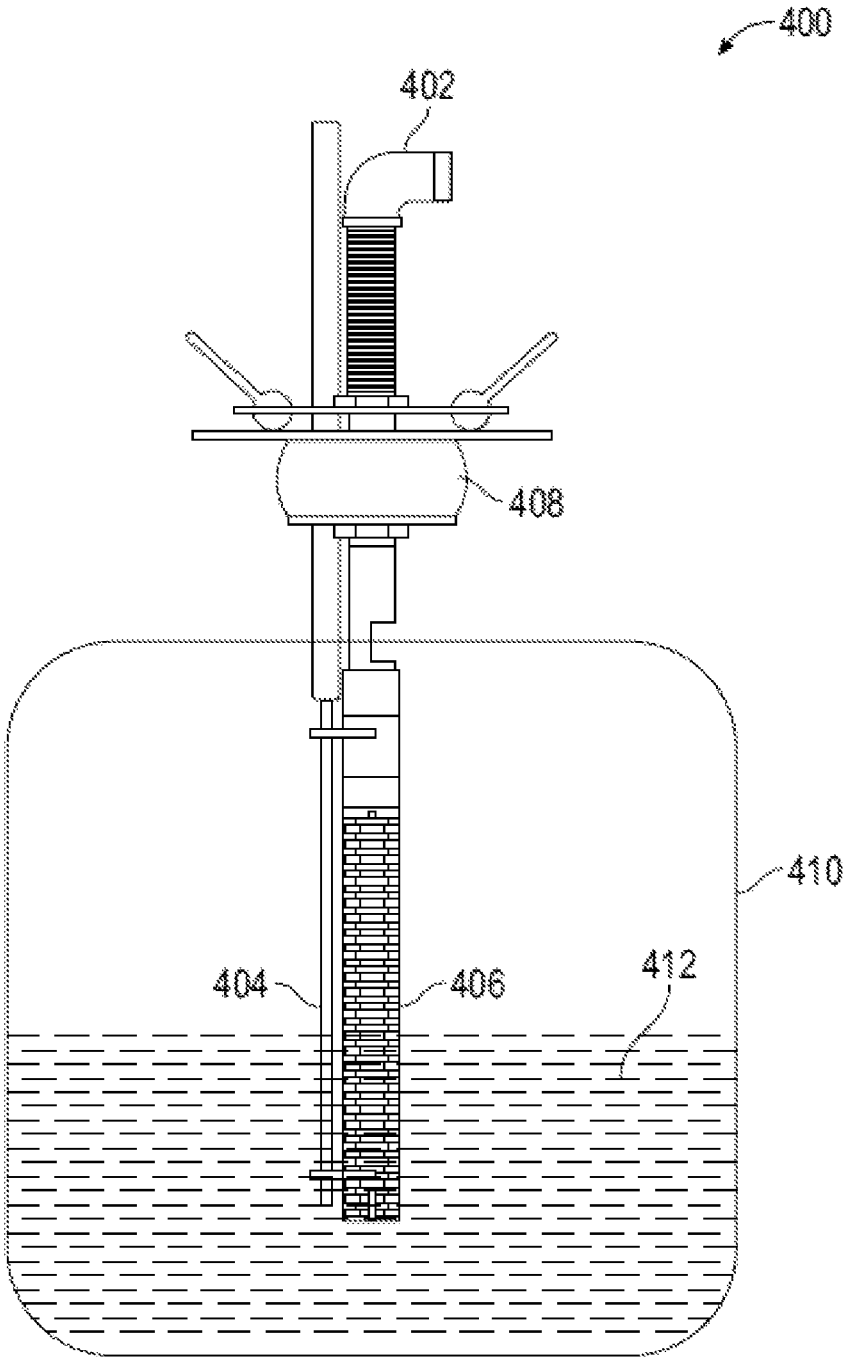
FIG. 4A illustrates a valve assembly fluidly coupled with fuel receiving tank or saddle/receiver tank to prevent fuel overfilling and spilling in accordance with an embodiment of the present invention.

FIG. 4A illustrates a valve assembly fluidly coupled with fuel receiving tank or saddle/receiver tank to prevent fuel overfilling and spilling in accordance with an embodiment of the present invention. Referring to FIG. 4A, the connecting end valve assembly 400 is specifically designed so that it fits universally to all types and sizes of frac truck pump unit saddle tank 410 (fuel receiving tank). Manually adjustable and the first of its kind, this valve is a revolutionary tool that prevents fuel overfilling and spilling. The valve has multiple fuel exit holes particularly designed to let the fuel exit in multiple directions and volumes and avoid clogging inside the tank. The design of the valve is also beneficial to keep track of the gallons dispensed in each saddle tank 410 at a certain pressure (PSI).

The fuel valve assembly 400 includes a mechanical float switch 406 for shutting off fuel flow to prevent overfilling; a machined stainless steel and aluminum valve head 402 specifically designed to avoid fuel clogging and enhance frac truck performance; an analog level sensor 404 to maintain fuel level in the receiving tank 410 and wirelessly transmitting the fuel level 412 to PLC and PID controller; internal float balls; sensor rod to sense the level 412 of fuel and air tight rubber locking mechanism 408. The level sensor 404 feeds back the fuel level to PLC then to PID wirelessly. The PLC and PID controls the concerned actuated valve coupled with reel to start or stop the supply of fuel in concerned saddle tank or receiving tank 224 based on feedback provided by the fuel level sensor 404. The automatically opening or closing of the actuated fuel valve 214 for the selected reel is facilitated through PLC/PID controller, when fuel level of receiving tank reaches a predefined set point (using tank level sensor).

In another embodiment of the present invention isolated fuel valve assembly 400 may include a buoyant body which is buoyant in liquid fuel due to a liquid and air tight lower end cap and upper end cap. The buoyant body is adapted to float at or near the top of the level of liquid fuel in each receiving fuel tank. As the buoyant body rises with the level of fuel in a receiving fuel tank being refueled due to its buoyancy, the buoyant body actuates a mechanical open-close isolated fuel valve 400 housed in an upper body into a closed position. Conversely, as the buoyant body lowers with the level of fuel in the receiving fuel tank as the fuel is used, the mechanical open-close isolated fuel valve 400 is reopened. The mechanical open-close valve 400 is adapted to be mechanically actuated by the buoyant body, either into a closed position or an open position, as the buoyant body responds to changing fuel levels within the receiving fuel tank and reaches a sufficiently high or sufficiently low position relative to the upper body.

The automated fueling system 100 of the present invention also employs artificial intelligence (AI) and cloud-based software that provides ease of operation and helps oil and gas companies to maximize economic performance. The present invention includes a fuel storage tank draining fuel into two or more channels; a plurality of pumps installed at the end of each of the two or more channels feeding; fuel to a plurality of reels having a flow meter and an isolation fuel valve to shut off fuel flow; a control chamber to manage and monitor fuel distribution. Also, the present system provides greater safety and efficient way for the refueling of frac truck tanks and the overall system can be monitored and controlled remotely through wired/wireless means.

Figure 4B:
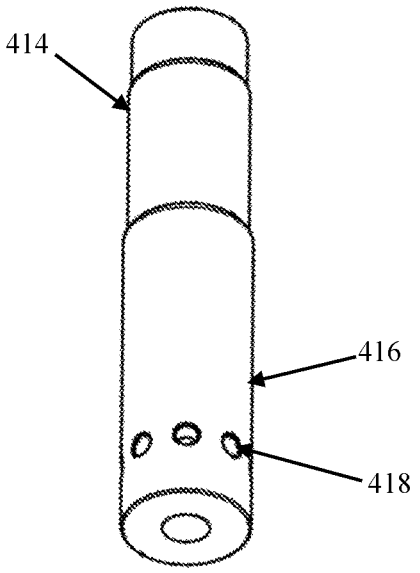
FIG. 4B to FIG. 4D illustrate an exploded view of an exemplary embodiment of fuel valve assembly in accordance with an embodiment of the present invention.
Figure 4C:
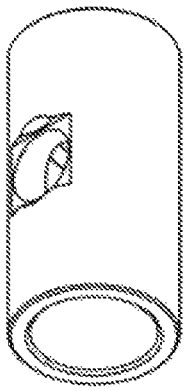
Figure 4D:
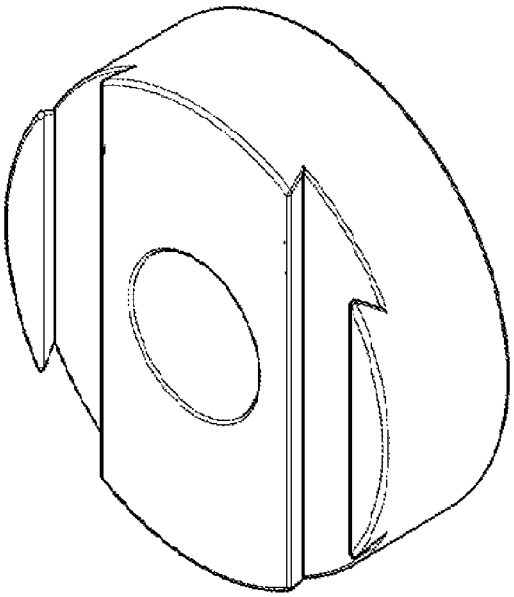

FIG. 4B, FIG. 4C and FIG. 4D illustrate an exploded view of an exemplary embodiment of fuel valve assembly in accordance with an embodiment of the present invention. Referring to FIG. 4B, it illustrates a sectional view of an exemplary embodiment of fuel valve assembly. In this embodiment valve assembly comprises an upper section 414, a lower section 416, air tight cap locking and multiple fuel exit holes 418 particularly designed to let the fuel exit in multiple directions and volumes and avoid clogging inside the tank. The design of the valve is also beneficial to keep track of the gallons dispensed in each saddle tank at a certain pressure (PSI). Both the upper section 414 and lower section 416 of the valve assembly can be adjusted upward and downward by rotating the cap locking. FIG. 4C shows the isolated view of the upper section 414 of the valve assembly. FIG. 4D illustrates the sectioned view of the cap locking.

Figure 5A:
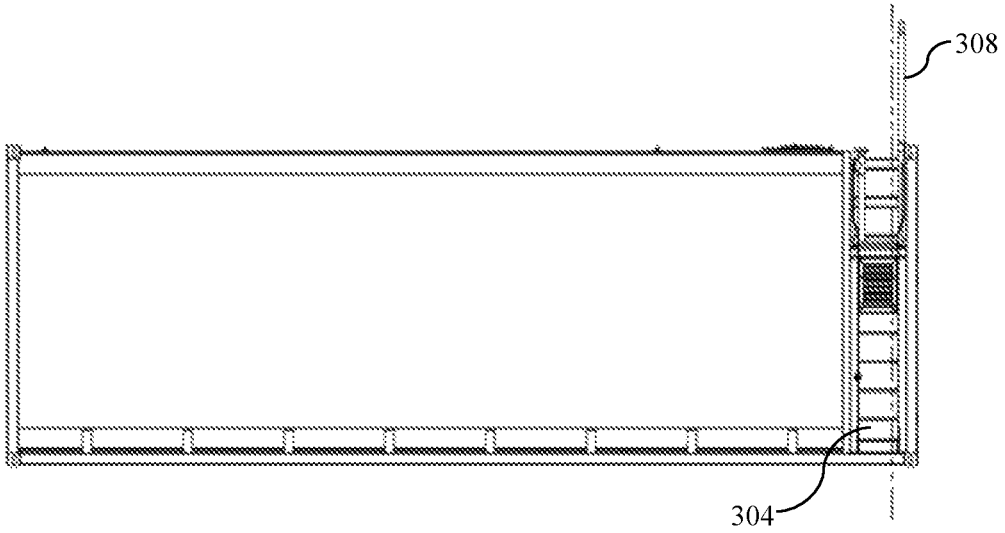
FIG. 5A shows the side view of the mobile trailer in accordance with an embodiment of the present invention.
Figure 5B:
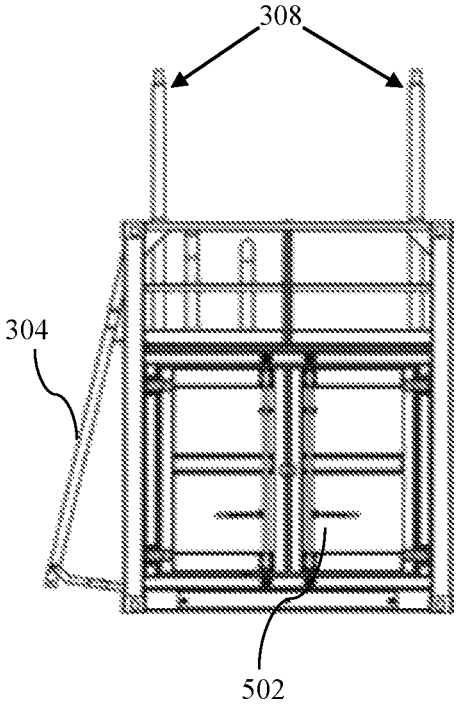
FIG. 5B shows the rear view of the mobile trailer in accordance with an embodiment of the present invention.
Figure 5C:
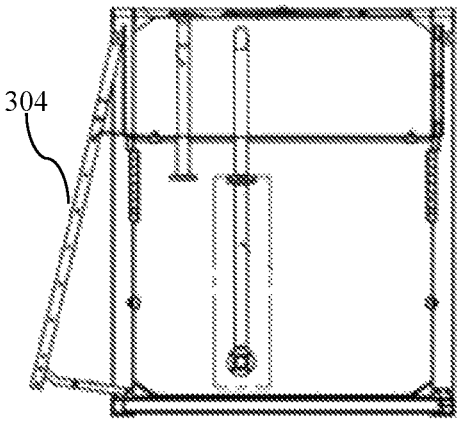
FIG. 5C shows the internal view of the rear of mobile trailer in accordance with an embodiment of the present invention.

FIG. 5A shows the side view of the mobile trailer in accordance with an embodiment of the present invention. Referring to FIG. 5A, it illustrates the side view of the trailer in accordance with an embodiment of the present invention. A ladder arrangement 304 is provided to access the top of the trailer 102 for fueling, servicing and other purposes before the mobile trailer 102 is transported to a work site or fracturing site. Couple of hose mast assembly 308 is provided at both the rear ends to pass the air; it is reversible to both sides. FIG. 5B shows the rear view of the mobile trailer in accordance with an embodiment of the present invention. The mobile trailer comprises a trailer end wall that has an outside door opening 502. The outside door opening 502 may be the conventional door or may be designed for any specific requirement. FIG. 5C shows the internal view of the rear of mobile trailer in accordance with an embodiment of the present invention.

Figure 6A:
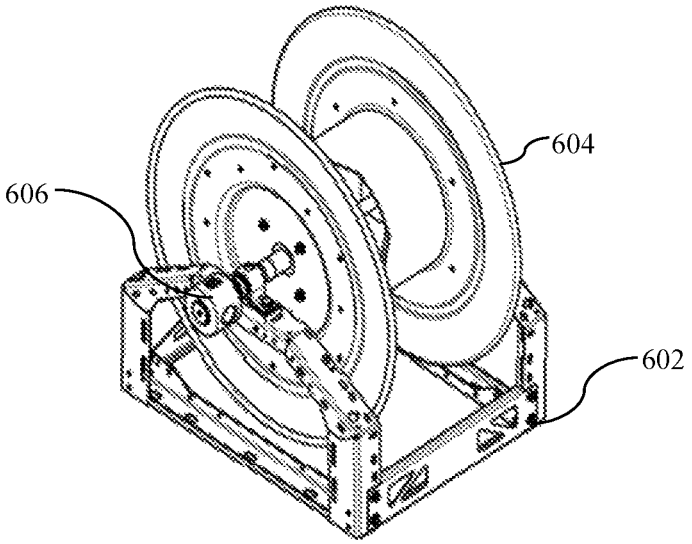
FIG. 6A and FIG. 6B show an illustrative view of reel assembly in accordance with an embodiment of the present invention.

FIG. 6A illustrates the isolated view of the reel mounted holding case in accordance with an embodiment of the present invention. With reference to FIG. 6A, the reel 604 is mounted on the holding case 602 and installed in the trailer 102 with the help of support rack (not shown). The hoses are stored in the reel by rotating it clockwise and anti-clockwise. A rotation mechanism 606 is provided by using a bearing case as shown in FIG. 6A. In the present embodiment of the invention the support rack is configured with upper and lower rows of reels as shown in FIG. 2, a total of 24 reels (i.e. 1-12 on one side and 13-23 on the other side of the trailer) and associated valves 214 to allow the hoses 216 exit and expand outside the trailer 102. For instance, a ratio of the number of reels in the upper row to a number of reels in the lower row on the support rack is 1:1. The reels are thus likewise arranged on opposed sides of the first compartment in the trailer 102. Each reel is associated with an isolation fuel valve 214 to control fuel flow. Each hose 216 is wound, at least initially, on a reel that is rotatable to extend or retract the hose 216 externally through one or more windows of the trailer 102. The plurality of hoses 216 stored in the plurality of respective reels 212 may be pulled out to equipment through an opening in the trailer 102 wall. Each hose 216 may include a connector end 218 and each integrated fuel cap sensor may have a corresponding mating connector to facilitate rapid connection and disconnection of the hose 216 with the integrated fuel cap sensor. The reels 604 may be mounted either internally or externally on the trailer 102, and may include electric or manual hose rewinders. The fuel source may be formed in part by one or more tanks that are used to store fuel. The tanks may be mounted on the same trailer as the rest of the automated fueling system 100 or on a separate trailer.

In an embodiment of the present invention the reels 212 may be manual reels or electric motor driven reels and have the ability to rewind/retract in and out. As the user pulls the hose from the reel a spring is biased to provide the force to retract the input hose when needed. The preferred embodiment of the present invention reel 212 is a manual reel however due to the weight of some fuel lines a hydraulically driven reel is contemplated by this application. Flow meter is configured to allow the system to report the fill status of the corresponding tank and the fuel tank usage over a stage level, a daily level, and a job level.

As far as the design and structure of the reel is concerned it has welded hybrid frame with added bolts, low profile outlet riser & open drum slot design for flat smooth hose wrap. Permanently lubricated self-aligning pillow block bearing for trouble-free & smooth rotation & robust lubricated horizontal surface mount bearing for easy rotation have been provided. Further, the long-handled locking pin is provided to secure reel from rotation during transport or storage.

The method to deliver the fuel to one or more frac truck tank using automated fueling system 100 comprises: pulling one or more hose 216 from one or more reel 604 and connecting it to one or more frac truck tank; selecting a reel 604 from plurality of reels to pump, by pressing a button on operator's screen to enable filling through that reel; opening of the isolation fuel valve for the selected reel (through PLC/CPU); turning on the pump associated with that reel; stopping/disabling isolation fuel valve and pump, when an operator selects "Stop" from the control chamber; and the tank level reaches a predefined set point (using tank level sensor).

Figure 6B:
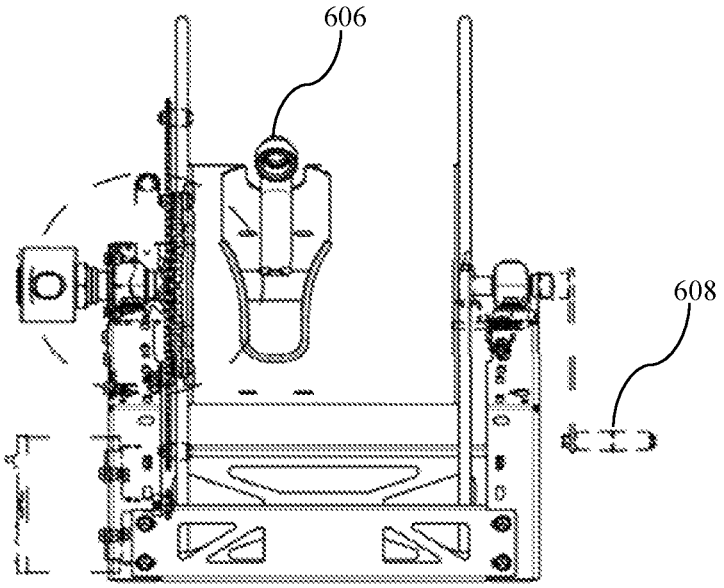
Figure 6C:
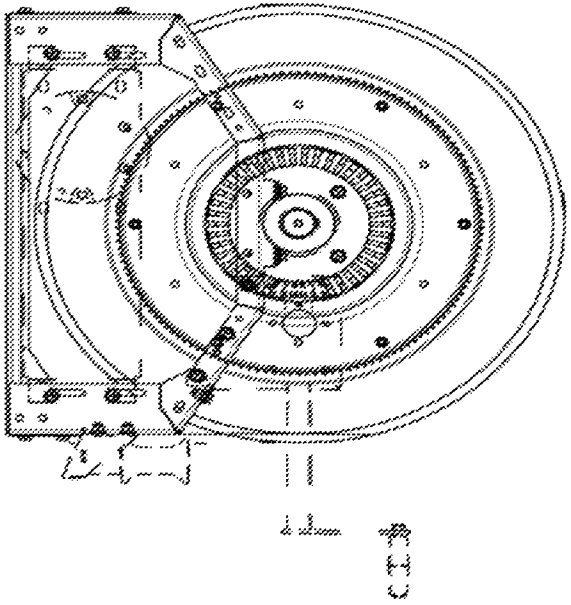
FIG. 6C and FIG. 6D show another illustrative view of reel assembly in accordance with an embodiment of the present invention.
Figure 6D:
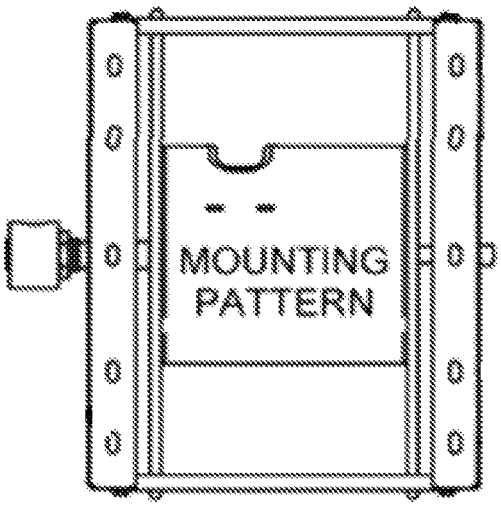

With reference to FIG. 6B, it shows the top view of the reel assembly 600 as shown in FIG. 6A. The reel may be rotated manually to store/expand hoses 216 in the reel by using a handle 608. In the bearing case 606 a mechanical bearing is fitted to make the rotation friction free. The reel 604 may be manual reel, or may be spring loaded. In order to accommodate the weight of hose on reels, the trailer frame may have to be braced sufficiently in order to prevent the hose from forcing the frame open. With reference to FIG. 6C, it shows the side view of the reel assembly 600 as shown in FIG. 6A and with reference to FIG. 6D, it illustrates the mounting pattern of the reel assembly 600.

The system 100 includes an inventive fuel valve that was specifically designed to fit in the saddle tank of the frac truck/pump units. The fuel valve is a mechanical float switch for shutting off fuel flow to prevent overfilling and spilling. Fuel valve comprises a mechanical float switch, float ball, and a level sensor for wirelessly transmitting the fuel level to the control chamber 202.

The manual valves may be readily accessible to an operator on the trailer. This can be arranged with the manifolds mounted on a wall of the trailer with the outlets extending inward of the trailer wall. Pressure gauges may be supplied on each of the outlets, one on the manifold side and one downstream of the valve. As fuel levels in the fuel tanks drop, a pressure differential between the pressure gauges can be used to determine a low fuel condition in the fuel tanks and the fuel tanks may be individually filled by an operator. During re-fueling at a fracturing job, the manual valves may remain open, and the operator may electrically signal the automatic valves to open, using an appropriate console linked to the valves. The level sensor at the fuel tank may be used to indicate a high level condition. An automatic system may be used to close the valves automatically in the case of a high fluid level detection or the operator may close the valves using the console.

Figure 7A:
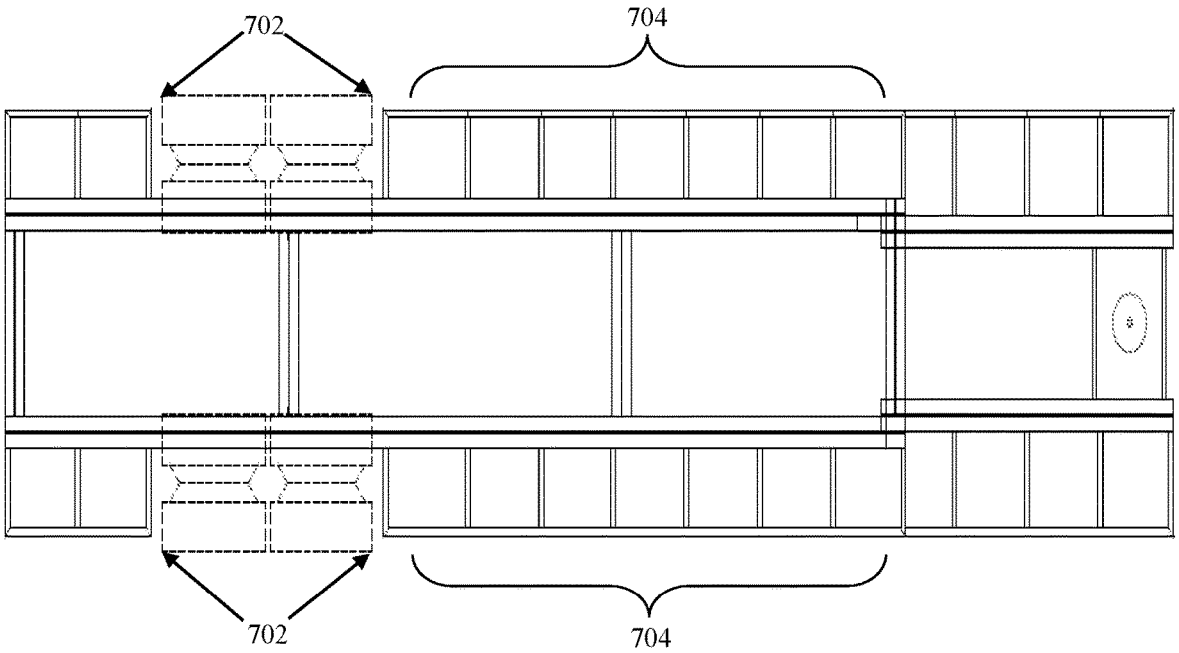
FIG. 7A to FIG. 7D illustrate an alternative embodiment of mobile trailer or mobile trailer for the automatic fueling system in according to the present invention.

FIG. 7A to FIG. 7D illustrate an alternative mobile trailer for the automatic fueling system in accordance with an embodiment of the present invention. FIG. 7A shows the perspective top view of the alternative mobile trailer. It comprises couple of axle cut-out 702 at both sides to install the wheel assembly, channel type base frame 704 to install the various components like reel, valve, pump etc. The mobile trailer side walls define trailer width. The mobile trailer have wheels installed in the axle cut-out that permit the mobile trailer to be moved by a vehicle from one site to other so as to service different hot-refueling operations.

Figure 7B:
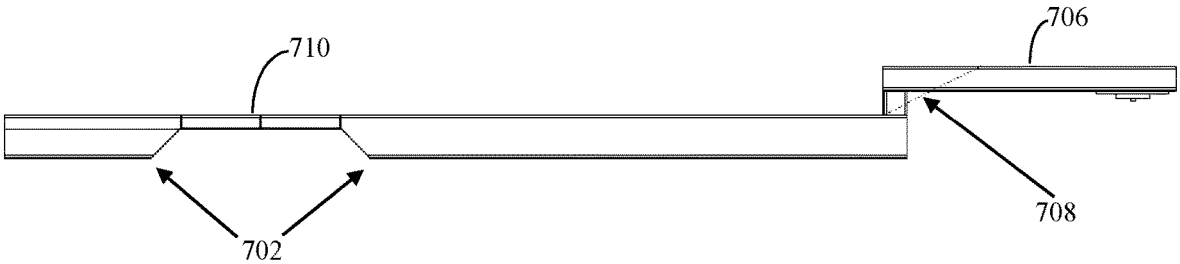

FIG. 7B shows the perspective side view of the alternative mobile trailer. Referring to FIG. 7B, it shows an axle cut-out 702 for installing the wheel assembly, a stiffener formation 710 to stiffen against out of plane deformations, an I-beam 706, gusset beam 708 is installed to stiffen the I-beam 706 either by bolts, rivets or welding or a combination of the three.

Figure 7C:
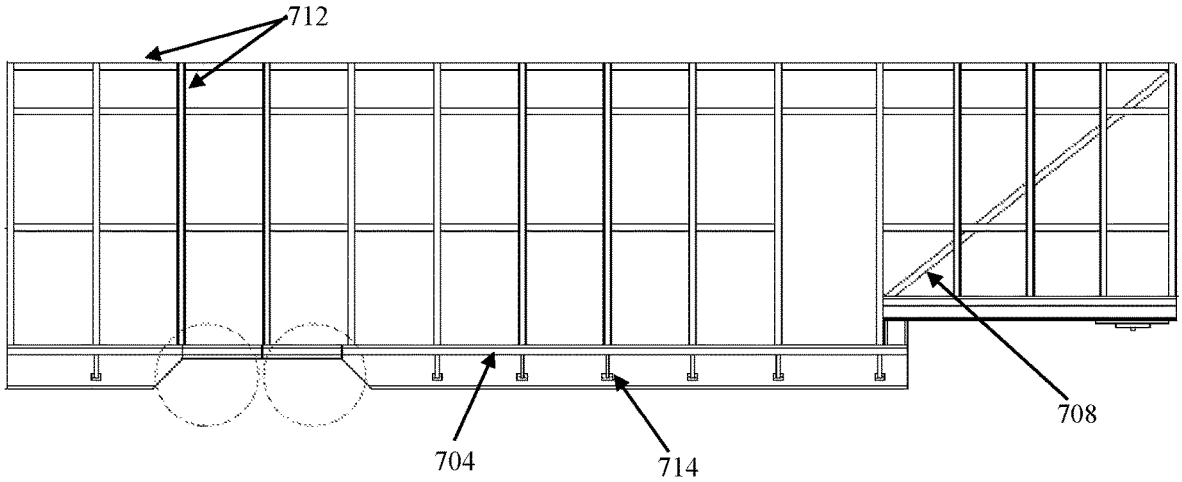
Figure 7D:
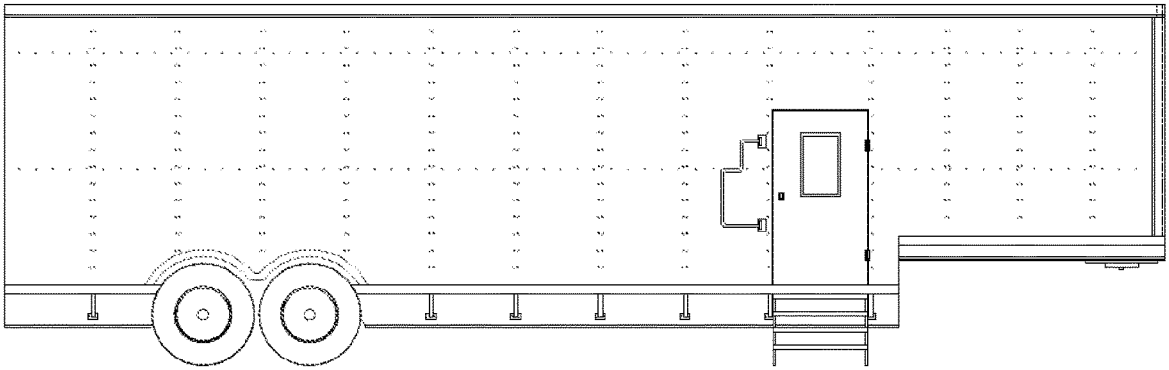

FIG. 7C illustrates an internal layout of the alternate mobile trailer of the present invention. It shows gusset beam 708 is installed to stiffen the I-beam either by bolts, rivets or welding or a combination of the three, rectangular tubes 712 attached horizontally and vertically, plurality of channels 704 for installing different components, plurality of kickers 714 to kick off the load/goods of mobile trailer. FIG. 7D illustrates the final layout of the alternative embodiment of the mobile trailer.

It should be understood that the foregoing relates only to illustrative embodiments of the invention, and that numerous changes may be made therein without departing from the scope and spirit of the invention as defined by the following claims. Additionally, the automated fueling system 100 may be utilized outside of the aviation industry wherever a need arises for the efficient and cost-effective monitoring, assigning, and accounting of fueling operations.

We claim:

1. A mobile fuel filling system for simultaneously filling a plurality of receiver tanks at a work site, the system comprising:

- a fuel storage tank for feeding fuel into one or more receiver tanks;
- at least one charge pump in fuel communication with the fuel storage tank to draw the fuel out of the storage tank and circulating the drawn fuel into a fuel circulating loop at a predetermined pressure;
- at least one pressure control valve positioned in the fuel circulating loop to maintain the predetermined pressure;
- a plurality of openings in the fuel circulating loop as an arm extension, wherein each of the plurality of openings provides drainage of fuel into a fuel hose;
- an actuated valve coupled with each of the fuel hoses to automatically start or stop the flow of fuel in the corresponding fuel hose;
- a connecting end valve assembly connected at the end of the fuel hose that couples to an opening in a receiver tank;
- an in-line flow meter connected to each of the fuel hoses to measure a quantity of fuel flow through each fuel hose;
- a control chamber comprising a PID controller to control the operation of the pressure control valve and the actuated valve, wherein the PID controller opens or closes the pressure control valve to maintain the predetermined pressure, and opens or closes the actuated valve of any fuel hose after receiving feedback from the connecting end valve assembly;

wherein the connecting end valve assembly comprises a mechanical float switch for shutting off fuel flow to prevent overfilling and spilling while supplying the fuel to the receiver tank;

a machined stainless steel and aluminum valve head having multiple fuel exit holes particularly designed to let the fuel exit in multiple directions and volumes to avoid clogging inside the receiver tank;

an analog level sensor to maintain desired fuel level in the receiving tank; and an airtight rubber locking mechanism to facilitate the connecting end valve assembly fitted tightly into the fuel inlet of the receiving tank and avoiding any leakage of fuel while fuel filling.

2. The system of claim 1, wherein the circulating loop controls and regulates the fuel flow through plurality of fuel hoses and maintains a predetermined pressure for operation of the fuel filling system.

3. The system of claim 1, wherein the control chamber comprises a programmable logic controller (PLC) with a touch screen for user input and display of status data.

4. The system of claim 1, wherein the programmable logic controller identifies non-standard fuel conditions and activates actuated valve(s) and other mechanical component(s) to achieve optimized fuel delivery rate into each hose.

5. The system of claim 1, wherein the PID controller controls the actuated valve precisely and smoothly to facilitate fuel flow at a desired rate.

6. The system of claim 1, wherein the pressure control valve is controlled by an artificial intelligence (AI) algorithm incorporated in the control chamber.

7. The system of claim 1, wherein the actuated valve coupled to each fuel hose is operated by the control signal received from a programmable logic controller (PLC) and the PID.

8. The system of claim 1, wherein the fuel storage tank is equipped with an audio/visual alarm system for preventing overfilling.

9. The system of claim 1, wherein the in-line flow meter measures the quantity of fuel dispensed and transmits it to the control chamber.

10. The system of claim 1 further comprising Blockchain-based distributed ledger for real-time monitoring for fuel metering and billing.

11. The system of claim 1 further comprising an engine to test water and fuel samples and to utilize an antimicrobial agent to treat contaminated diesel fuel and water bottoms in fuel storage tanks.

* * * * *